US006983936B1

(12) United States Patent
Clapper

(10) Patent No.: US 6,983,936 B1
(45) Date of Patent: Jan. 10, 2006

(54) BOBBLEHEAD TRIVIA BASEBALL

(76) Inventor: Edward A. Clapper, 831 W. Main Ave., Massillon, OH (US) 44647

( * ) Notice: Subject to any disclaimer, the term of this patent is extended or adjusted under 35 U.S.C. 154(b) by 15 days.

(21) Appl. No.: 10/734,718

(22) Filed: Dec. 15, 2003

(51) Int. Cl.
*A63F 3/00* (2006.01)

(52) U.S. Cl. ..... 273/244.1; 273/288

(58) Field of Classification Search ..... 273/244.1, 273/247, 288; D21/356
See application file for complete search history.

(56) References Cited

U.S. PATENT DOCUMENTS

| | | | | |
|---|---|---|---|---|
| D152,174 | S | 12/1948 | Silverman | |
| 3,190,653 | A * | 6/1965 | Karthaus | 273/108.22 |
| 4,000,897 | A | 1/1977 | York | |
| 4,165,710 | A * | 8/1979 | Gaetano | 116/223 |
| 4,216,966 | A * | 8/1980 | MacRae | 273/243 |
| 4,569,529 | A | 2/1986 | Gibbs | |
| 4,921,251 | A | 5/1990 | Kanenwisher | |
| 5,746,431 | A | 5/1998 | McIntyre et al. | |
| 5,884,914 | A | 3/1999 | Lilien | |
| D417,701 | S * | 12/1999 | Jack | D19/52 |
| 6,530,571 | B1 * | 3/2003 | McWilliams | 273/244.2 |

* cited by examiner

*Primary Examiner*—Vishu K. Mendiratta

(57) ABSTRACT

A sports trivia board game includes a game board having a substantially planar top surface and indicia thereon for illustrating a baseball field. The game board further includes a six-sided die, a plurality of playing cards for providing trivia questions for players to ask one another, and a mechanical mechanism for displaying a player's ball and strike count. The board game further includes a plurality of game pieces including upper and lower portions and a plurality of spring members for connecting the upper and lower portions to each other. When select ones of the plurality of game pieces are moved across the game board, the upper portion of a game piece is thereby caused to oscillate about the spring member. The board game further includes a plurality of score pads, a plurality of writing utensils, and a reusable scoreboard having a dry-erase surface for keeping track of a player's score.

12 Claims, 6 Drawing Sheets

BOBBLEHEAD TRIVIA BASEBALL

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

The present invention relates to a sports board game, and more particularly, to a baseball trivia board game that simulates the real play of a baseball game.

2. Prior Art

As the popularity of sports grows, so grows the sophistication of fans in their knowledge about matters concerning their favorite teams. Fans take pride in their knowledge of the history, exploits and personalities of their favorite teams. Board games that represent sports such as baseball are generally applicable to the entire scope of all teams or they are games of chance where a probability device such as a die, spinner or card is used to create an event. Many sport games have been developed, but these games ordinarily do not utilize and test a player's trivia knowledge.

The prior art games are complicated because of the use of various methods of probability devices such as a die or spinner, sometimes in concert with a card drawn from a deck of cards that specify various outcomes. Game complexity constitutes a problem for the successful introduction of an entertainment game.

Further, the prior art games have lacked a suitable feature that allows a group of people to play in a setting such as a sport weekend gathering where those present are divided in their loyalty to the teams represented. More specifically, baseball related board games heretofore disclosed and utilized for the purpose of entertaining users by playing the games in the suggested manner are known to consist basically of familiar, expected and obvious structural configurations, notwithstanding the myriad of designs encompassed by the crowded prior art which have been developed for the fulfillment of countless objectives and requirements. While the prior art fulfills its respective, particular objectives and requirements, it does not disclose a baseball trivia board game for specifically simulating the play of a professional baseball game.

Accordingly, a need remains for a simple, easy to use, multi-player board game based upon baseball trivia and simulating the play of a professional baseball game.

BRIEF SUMMARY OF THE INVENTION

In view of the foregoing background, it is therefore an object of the present invention to provide an apparatus for playing a baseball trivia game. These and other objects, features, and advantages of the invention are provided by a baseball trivia board game including a game board having indicia thereon for illustrating a baseball field and having a substantially planar top surface. The game board includes a plurality of edge portions integral therewith and extending upwardly therefrom in a substantially vertical direction. The game board further includes a six-sided die for displaying 1, 2, 3, homerun, pop-out and pop-out, respectively, a plurality of playing cards for providing trivia questions for players to ask one another, and a mechanical mechanism for displaying a score of a player. The mechanical mechanism includes a hand-held device including a display screen and a plurality of dials or wheels.

The board game further includes a plurality of game pieces including upper and lower portions and a plurality of spring members for connecting the upper and lower portions to each other. The spring members include opposed end portions connected to the top and bottom portions of the plurality of game pieces to thereby allow the spring member to become compressed in a substantially vertical direction. When select ones of the plurality of game pieces are moved across the game board, the upper portion of a game piece is caused to oscillate about the spring member.

The board game further includes a plurality of score pads and a plurality of writing utensils for keeping track of a player's score. A reusable scoreboard having a dry-erase surface allows a player to keep track of a player's score. The scoreboard includes a substantially rectangular top member and a base member having a slot. The top member is removably engageable within the slot and slidably positionable therealong. The base member has a groove spaced from the slot and extends substantially parallel thereto for receiving the plurality of writing utensils thereon.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
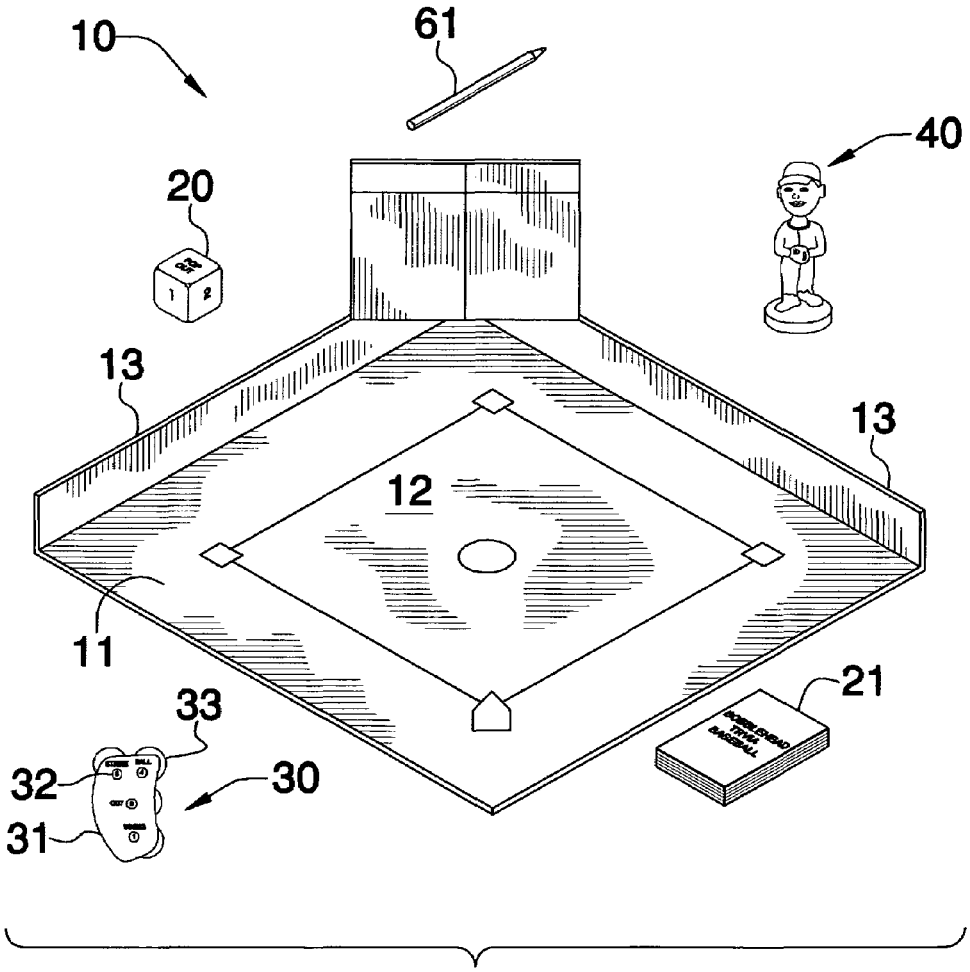
FIG. 1 is a perspective view showing a baseball trivia board game, in accordance with the present invention.
Figure 2:
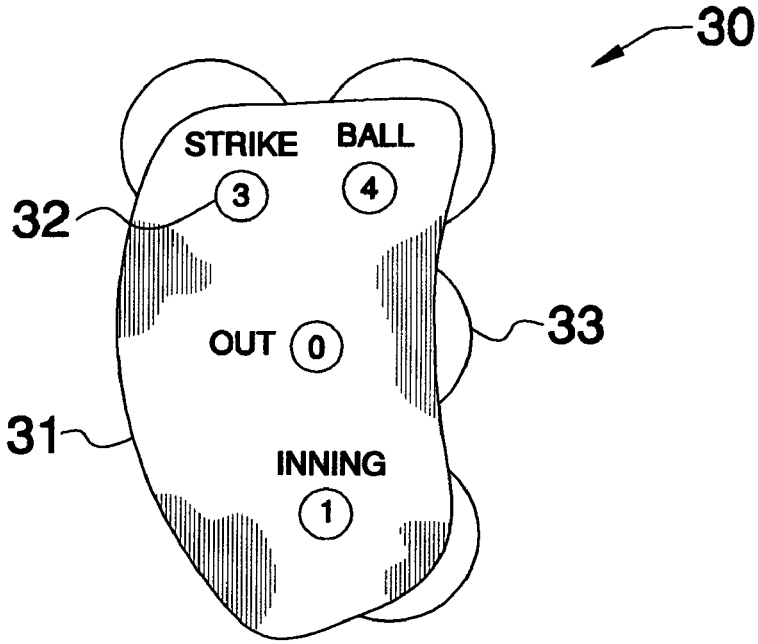
FIG. 2 is a top plan view of the mechanical scorekeeping mechanism shown in FIG. 1.

The present invention will now be described more fully hereinafter with reference to the accompanying drawings, in which a preferred embodiment of the invention is shown. This invention may, however, be embodied in many different forms and should not be construed as limited to the embodiments set forth herein. Rather, this embodiment is provided so that this application will be thorough and complete, and will fully convey the true scope of the invention to those skilled in the art.

The apparatus of this invention is referred to generally in FIGS. 1–6 by the reference numeral 10 and is intended to provide a baseball trivia board game. It should be understood that the board game 10 may be played based upon American or International baseball rules.

Referring to FIG. 1, the board game 10 includes a game board 11 having indicia thereon for illustrating a baseball field and having a substantially planar top surface 12. The game board 11 includes a plurality of edge portions 13 integral therewith and extending upwardly therefrom in a substantially vertical direction. The edge portions 13 act as an outfield fence or wall for the baseball field that provides separation between the players and fans much as a real ballpark does.

Figure 5:
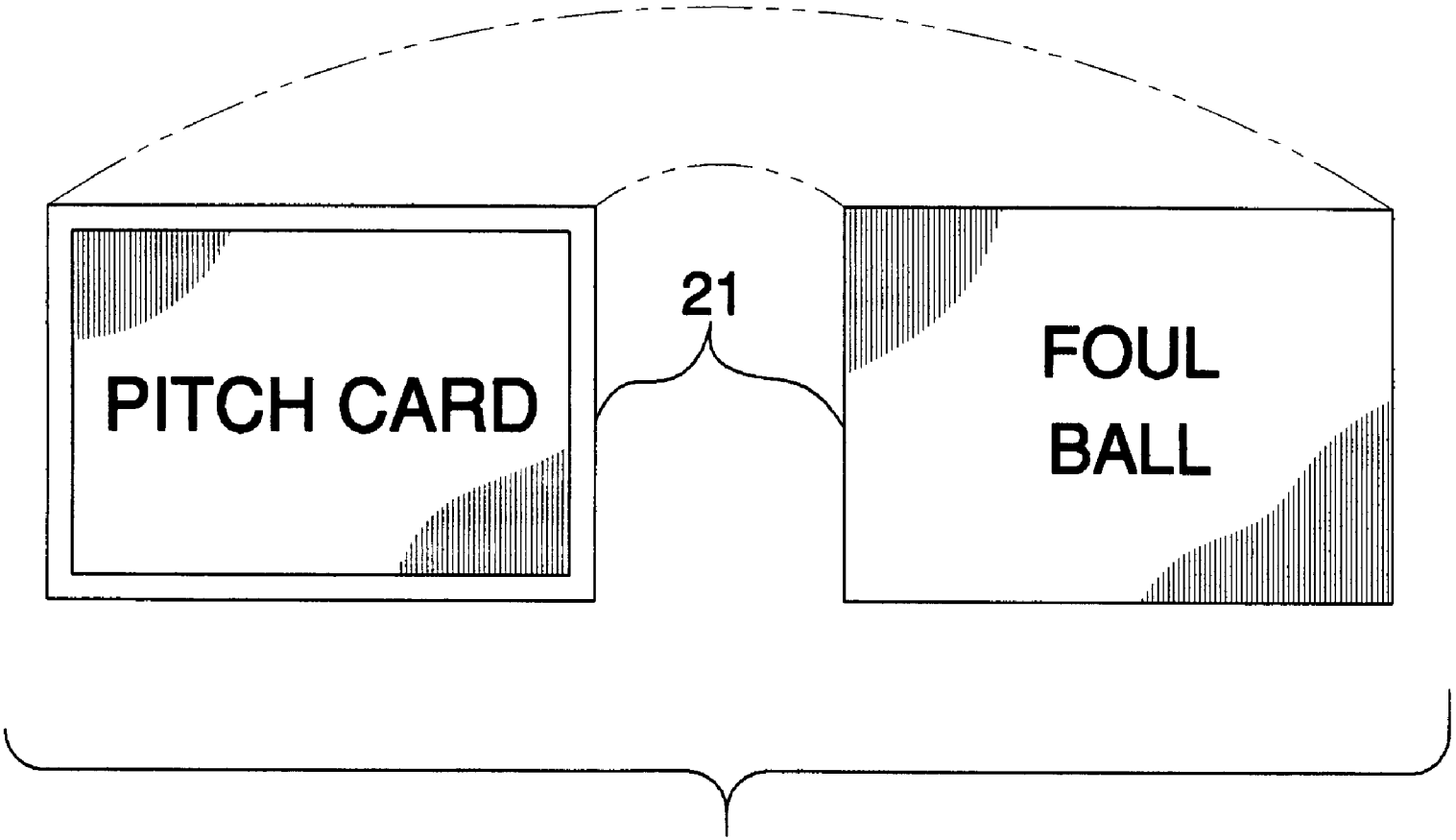
FIG. 5 is a perspective view of select ones of the playing cards shown in FIG. 1.

Still referring to FIG. 1, the game board 11 further includes a uniquely marked six-sided die 20 displaying 1, 2, 3, homerun, pop-out and pop-out, respectively, a plurality of playing cards 21 for providing trivia questions for players to ask one another as shown in FIG. 5, and a mechanical mechanism 30 for displaying the ball and strike count of a player. The mechanical mechanism 30 includes a hand-held device 31 including a display screen 32 and a plurality of dials or wheels 33, as perhaps best shown in FIG. 2. Advantageously, the mechanical mechanism 30 provides a hand-held ball and strike counter similar to those used by real life baseball umpires as an aid in remembering and tallying the pitch count on a batter.

Figure 3:
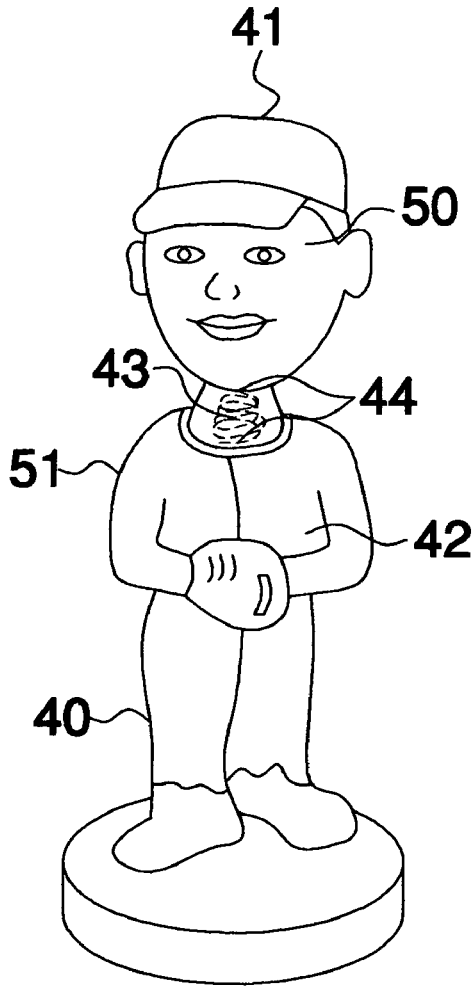
FIG. 3 is an enlarged perspective view of an oscillating game piece shown in FIG. 1.

Now referring to FIG. 3, the game board 11 further includes a plurality of game pieces 40 including upper 41 and lower 42 portions and a plurality of spring members 43 for connecting the upper 41 and lower 42 portions to each other. The spring members 43 include opposed end portions 44 connected to the top 50 and bottom 51 portions of the plurality of game pieces 40 to thereby allow the spring member 43 to be compressed in a substantially vertical direction. When select ones of the plurality of game pieces 20 are moved across the game board 11, the upper portion 41 of a game piece 40 is caused to oscillate about the spring member 43. The oscillating action of the game pieces 40 simulates the action of a baseball game and provides an exciting enhancement to the board game. The game pieces 40 are preferably formed of plastic but may be formed of other suitable moldable material, as well known in the art, and may be painted to replicate the uniforms of select major league baseball teams.

Figure 4:
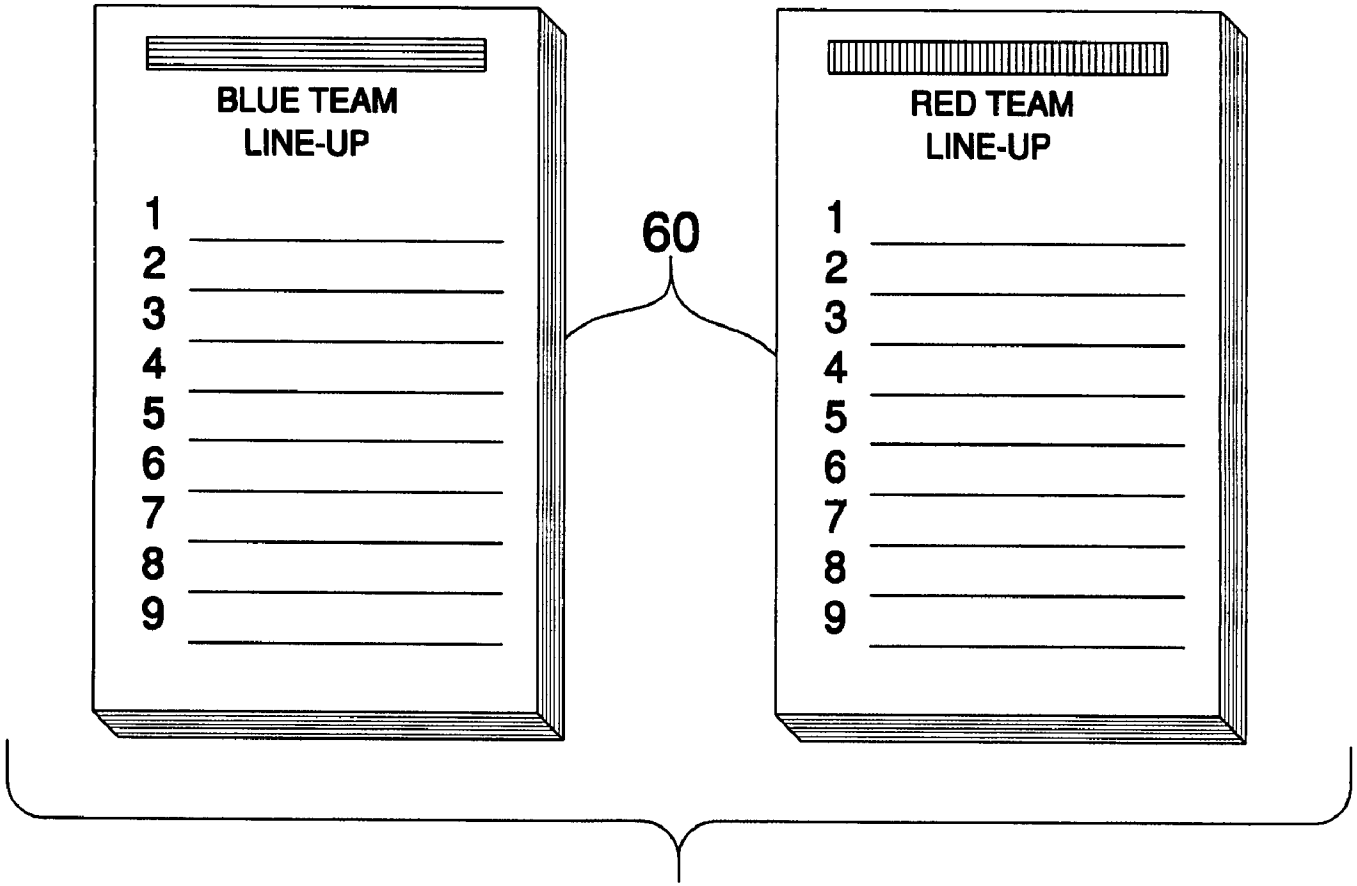
FIG. 4 is a perspective view of the score pads shown in FIG. 1.
Figure 6:
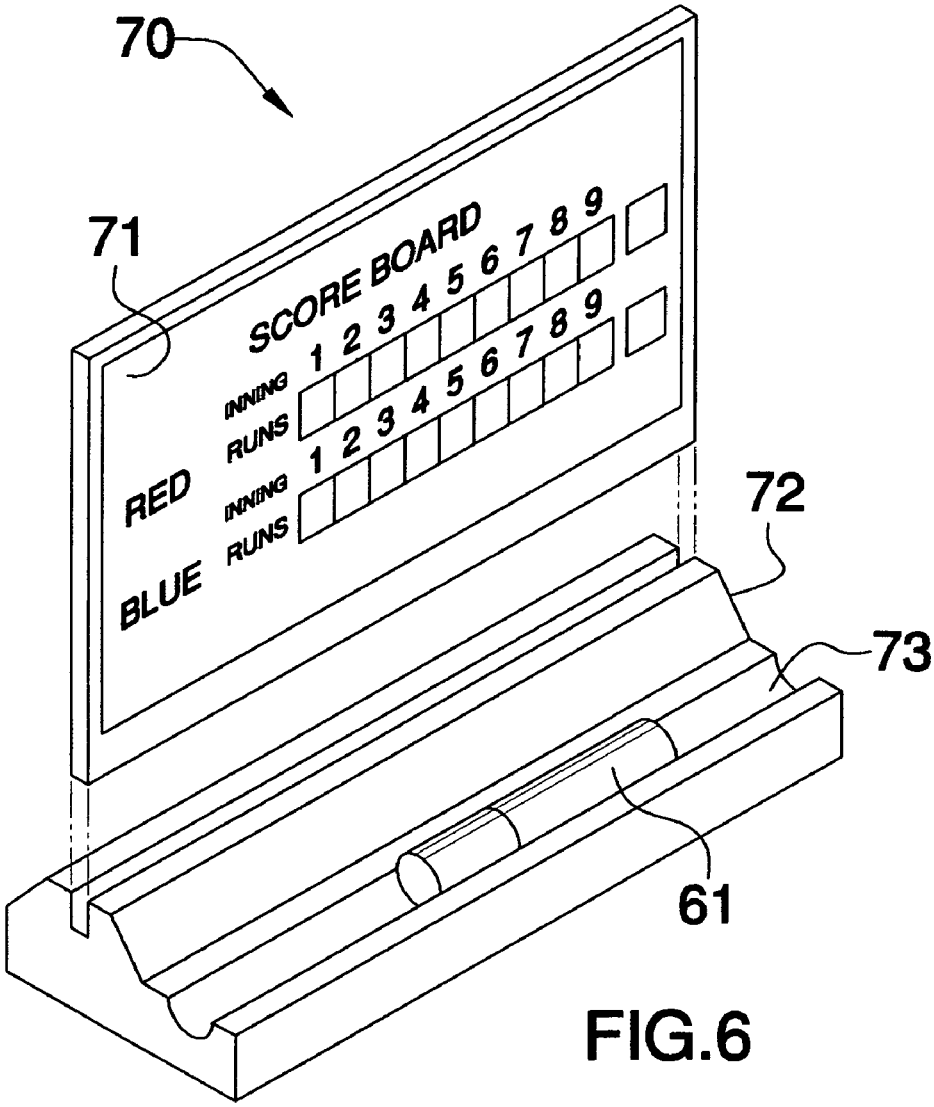
FIG. 6 is a perspective view of the reusable scoreboard shown in FIG. 1.
Figure 7:
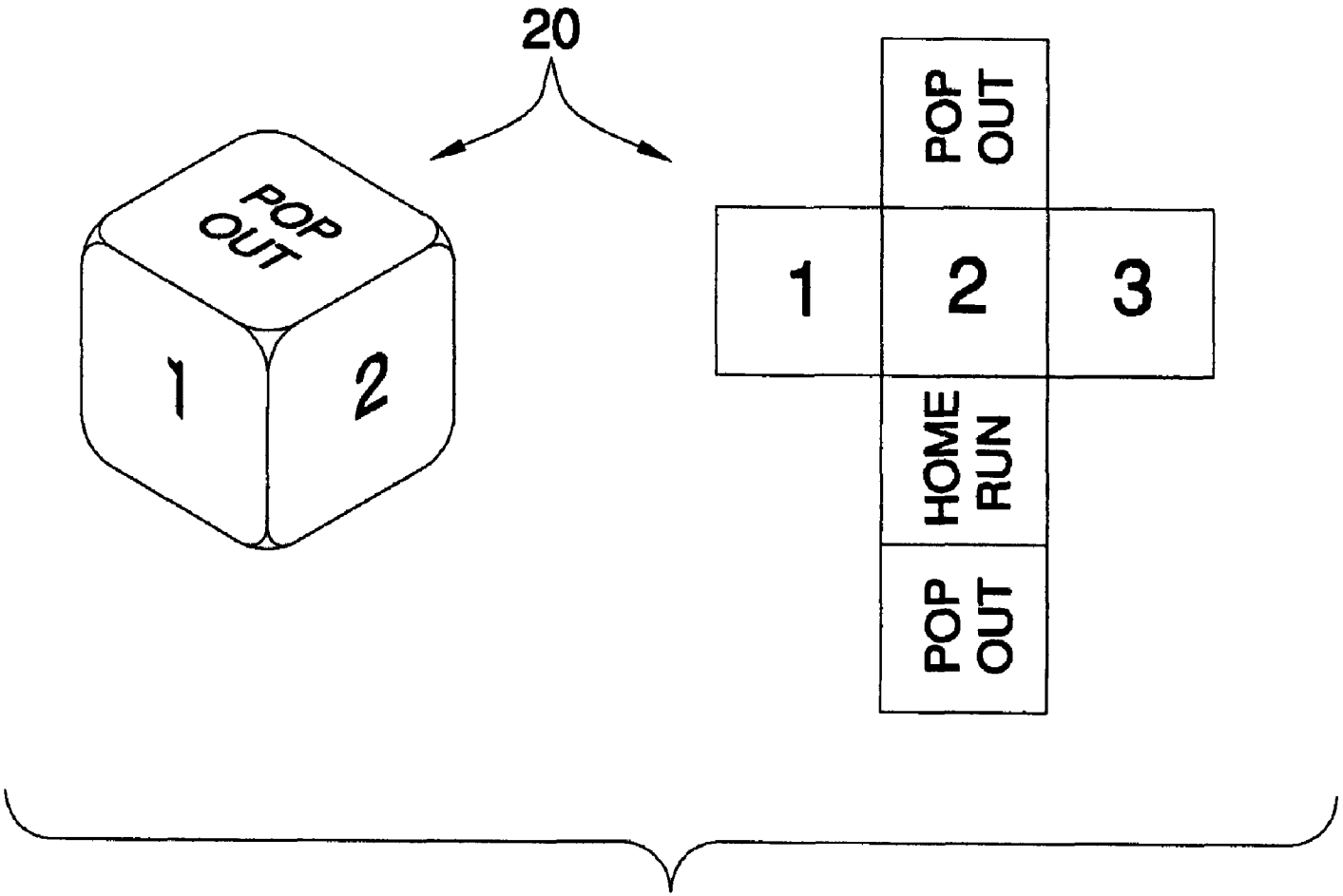
FIG. 7 shows perspective and top plan views of the six-sided die at folded and unfolded positions, respectively.

Now referring to FIGS. 4 and 6, the board game 10 further includes a plurality of score pads 60 and a plurality of writing utensils 61 for keeping track of a player's score. The score pads 60 may be customized by each player to include the name of his/her favorite players, making the board game 10 as realistic as possible. A reusable scoreboard 70 having a dry-erase surface allows a player to keep track of his/her score. The scoreboard 70 includes a substantially rectangular top member 71 and a base member 72 having a slot 73. The top member 71 is removably engageable within the slot 73 and slidably positionable therealong. The base member 72 has a groove spaced from the slot 73 and extends substantially parallel thereto for receiving the plurality of writing utensils 61 thereon. The scoreboard 70 may simulate a scoreboard in a real baseball park further adding to the impression that one is playing a real baseball game.

Advantageously, the present invention further includes a detailed set of rules for instructing the players how to play the game. In particular, to play the board game 10, players would divide into teams. The board game 10 may be played with one or more players on each team. Teams with multiple players may write down the order of play as their line-up. On each turn, a pitcher for the opposing team would draw a pitch card. The card may be imprinted with a trivia question or with one of a plurality of baseball terms such as ball, foul ball, hit batter, intentional walk, double play, or wild pitch. If a player accumulates four balls, he would receive a "walk" and automatically gain a base. The player would also gain a base on the drawing of a "hit batter" card.

Intentional walk and double play cards may be saved by the pitcher for use at any time. If the pitcher draws a trivia card, he reads the card to the batter. If the batter answers incorrectly, it would count as a strike. A strike would also be called if a teammate answered the question or if the batter took to long to answer. If the player accumulates three strikes, he would be out.

If the player answers the question correctly, he would roll the die to determine the result of his "hit." Whenever a player crosses home plate, a run would be scored for his team. The game would continue in this manner for nine innings. The team with the highest score at the end of the game would win.

The board game 10 provides an entertaining and engaging pastime that would have special appeal to sports trivia fans. While luck is inherent in the drawing of the cards, knowledge of sports facts and figures would be required to answer the wide variety of questions. The board game 10 may be played by participants of all ages, making the game a great family activity. The board game 10 is inexpensive and lightweight for easy portability and could serve as an ideal party game.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A baseball board game comprising:

a game board having a substantially planar top surface and a plurality of edge portions integral therewith and extending upwardly therefrom in a substantially vertical direction, said game board having indicia thereon for illustrating a baseball field;

a six-sided die having indicia thereon for designating an action of a player;

a plurality of playing cards for providing trivia questions for players to ask one another;

mechanical means for displaying a ball and strike count of a player, said mechanical means comprising a hand-held device including a display screen and one of a plurality of dials and wheels; and a plurality of game pieces including upper and lower portions and a spring member for connecting said upper and lower portions to each other so that when select ones of said plurality of game pieces are moved across said game board said upper portion is caused to oscillate about said spring member.

2. The board game of claim 1, further comprising:

a plurality of score pads and a plurality of writing utensils for keeping track of a player score.

3. The board game of claim 1, further comprising:

a reusable score board having a dry-erase surface for allowing a player to keep track of a player score, said score board including a substantially rectangular top member and a base member having a slot, said top member being removably engageable within said slot and being slidably positionable therealong.

4. The board game of claim 1, wherein said base member has a groove spaced from said slot and extending substantially parallel thereto, said groove for receiving said plurality of writing utensils thereon.

5. The board game of claim 1, wherein said spring members include opposed end portions connected to said top and bottom portions of said plurality of game pieces to thereby allow said spring member to be compressed in a substantially vertical direction.

6. A baseball board game comprising:

a game board having a substantially planar top surface and a plurality of edge portions integral therewith and extending upwardly therefrom in a substantially vertical direction, said game board having indicia thereon for illustrating a baseball field;

a six-sided die having indicia thereon for designating an action of a player;

a plurality of playing cards for providing trivia questions for players to ask one another;

mechanical means for displaying a ball and strike count of a player, said mechanical means comprising a hand-held device including a display screen and one of a plurality of dials and wheels;

a plurality of game pieces including upper and lower portions and a spring member for connecting said upper and lower portions to each other so that when select ones of said plurality of game pieces are moved across said game board said upper portion is caused to oscillate about said spring member; and a plurality of score pads and a plurality of writing utensils for keeping track of a player score.

7. The board game of claim 6, further comprising:

a reusable score board having a dry-erase surface for allowing a player to keep track of a player score, said score board including a substantially rectangular top member and a base member having a slot, said top member being removably engageable within said slot and being slidably positionable therealong.

8. The board game of claim 6, wherein said base member has a groove spaced from said slot and extending substantially parallel thereto, said groove for receiving said plurality of writing utensils thereon.

9. The board game of claim 6, wherein said spring members include opposed end portions connected to said top and bottom portions of said plurality of game pieces to thereby allow said spring member to be compressed in a substantially vertical direction.

10. A baseball board game comprising:

a game board having a substantially planar top surface and a plurality of edge portions integral therewith and extending upwardly therefrom in a substantially vertical direction, said game board having indicia thereon for illustrating a baseball field;

a six-sided die having indicia thereon for designating an action of a player;

a plurality of playing cards for providing trivia questions for players to ask one another;

mechanical means for displaying a ball and strike count of a player, said mechanical means comprising a hand-held device including a display screen and one of a plurality of dials and wheels;

a plurality of game pieces including upper and lower portions and a spring member for connecting said upper and lower portions to each other so that when select ones of said plurality of game pieces are moved across said game board said upper portion is caused to oscillate about said spring member;

a plurality of score pads and a plurality of writing utensils for keeping track of a player score; and a reusable score board having a dry-erase surface for allowing a player to keep track of a player score, said score board including a substantially rectangular top member and a base member having a slot, said top member being removably engageable within said slot and being slidably positionable therealong.

11. The board game of claim 10, wherein said base member has a groove spaced from said slot and extending substantially parallel thereto, said groove for receiving said plurality of writing utensils thereon.

12. The board game of claim 10, wherein said spring members include opposed end portions connected to said top and bottom portions of said plurality of game pieces to thereby allow said spring member to be compressed in a substantially vertical direction.

* * * * *